US009415587B1

(12) United States Patent
Fukazawa

(10) Patent No.: US 9,415,587 B1
(45) Date of Patent: Aug. 16, 2016

(54) PRINTING CONTROL APPARATUS AND PRINTING CONTROL METHOD

(71) Applicant: Seiko Epson Corporation, Tokyo (JP)

(72) Inventor: Masahiro Fukazawa, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/042,551

(22) Filed: Feb. 12, 2016

(30) Foreign Application Priority Data

Mar. 17, 2015 (JP) ..... 2015-053258

(51) Int. Cl.
*B41J 2/045* (2006.01)

(52) U.S. Cl.
CPC ..... *B41J 2/04551* (2013.01); *B41J 2/04586* (2013.01)

(58) Field of Classification Search
CPC ..... B41J 2/04501; B41J 2/04503; B41J 2/04505; B41J 2/04506; B41J 2/04508; B41J 2/0451; B41J 2/04511; B41J 2/04513; B41J 2/04515; B41J 2/04516; B41J 2/04518; B41J 2/0452; B41J 2/04521; B41J 2/04523; B41J 2/04525; B41J 2/04526; B41J 2/0453; B41J 2/04531; B41J 2/04533; B41J 2/04535; B41J 2/04536; B41J 2/04538; B41J 2/0454; B41J 2/04541; B41J 2/04543; B41J 2/04545; B41J 2/04546; B41J 2/04548; B41J 2/0455; B41J 2/04551; B41J 2/04553; B41J 2/04556; B41J 2/0456; B41J 2/04561; B41J 2/04563; B41J 2/04565; B41J 2/04566; B41J 2/04568; B41J 2/0457; B41J 2/04571; B41J 2/04573; B41J 2/04575; B41J 2/04583; B41J 2/04585; B41J 2/04586; B41J 2/04588; B41J 2/0459; B41J 2/04591; B41J 2/04593; B41J 2/04595; B41J 2/04596; B41J 2/04598; B41J 2/07; B41J 2/072; B41J 2/075; B41J 2/08; B41J 2/085; B41J 2/09; B41J 2/095; B41J 2/105; B41J 2/11; B41J 2/115; B41J 2/12; B41J 2/125; B41J 2/13; B41J 2002/022
See application file for complete search history.

(56) References Cited

U.S. PATENT DOCUMENTS 5,477,246 A * 12/1995 Hirabayashi ..... B41J 2/04528 347/12
6,827,418 B2 * 12/2004 Otokita ..... B41J 11/009 347/12
7,581,798 B2 * 9/2009 Arazaki ..... B41J 29/393 347/12
7,651,186 B2 * 1/2010 Yoshida ..... B41J 11/0035 347/14
2002/0051022 A1 5/2002 Hosono

FOREIGN PATENT DOCUMENTS

JP 2002-127399 A 5/2002
JP 2002-192714 A 7/2002
JP 2014-148110 A 8/2014

* cited by examiner

*Primary Examiner* — Kristal Feggins

(57) ABSTRACT

A printing control apparatus which realizes printing by controlling a printing head including nozzle rows in which a plurality of nozzles are arranged in a predetermined nozzle row direction, the apparatus including a control section that controls the printing head in which the plurality of nozzle rows discharging same types of ink are disposed to be deviated from the nozzle row direction, in which the control section is capable of selecting and performing any one of a first printing mode in which the printing is performed by setting a platen gap which is a distance from a platen supporting the printing medium on which the ink is discharged to the printing head as a first platen gap, and a second printing mode in which the printing is performed by setting the platen gap as a second platen gap which is narrower than the first platen gap.

5 Claims, 6 Drawing Sheets

FIG. 4

T

| PRINTING MEDIUM | SINGLE-SURFACE/ DOUBLE-SURFACE PRINTING | RUBBING REDUCING MODE | PG (mm) | PRINTING RESOLUTION (dpi) | | NUMBER OF USED NOZZLE ROWS | WEIGHT OF INK DROPLETS (ng) |
|---|---|---|---|---|---|---|---|
| | | | | HORIZONTAL | VERTICAL | | |
| REGULAR PAPER | SINGLE SURFACE | OFF | 0.9 | 1200 | 1200 | 4 | 8 |
| | | ON | 2.5 | 600 | 600 | 2 | 16 |
| | DOUBLE SURFACE | OFF | 2.0 | 900 | 1200 | 4 | 8 |
| | | ON | 2.5 | 600 | 600 | 2 | 16 |
| ENVELOPE | SINGLE SURFACE | OFF | 4.4 | 600 | 600 | 2 | 16 |
| | | ON | 4.4 | 600 | 600 | 2 | 16 |

PRINTING CONTROL APPARATUS AND PRINTING CONTROL METHOD

BACKGROUND

1. Technical Field

The present invention relates to a printing control apparatus and a printing control method.

2. Related Art

An ink jet printer is known which performs printing by discharging ink to a printing medium using a printing head which includes nozzle rows in which a plurality of nozzles capable of discharging the ink are arranged in a nozzle row direction. In the ink jet printer, a platen gap (hereinafter, PG) which is a distance from a platen supporting the printing medium on which the ink is discharged to the printing head is varied according to differences of the printing medium being used, or the like.

In addition, in the ink jet printer, when discharging the ink from the nozzles, together with discharged ink droplets (the main droplets), droplets which are so-called satellites, or the like, which are fine compared to the main droplets are discharged. The satellites are referred to as sub-droplets. In addition, a part of the main droplets which are discharged and flown is scattered and becomes the sub-droplets.

Also, a recording operation is known in which one ink droplet is ejected from the nozzle when a distance from a nozzle formed surface of a recording head to a recording medium is relatively short (for example, 1 mm or less), two ink droplets are continuously ejected from the nozzle (two ink droplets are combined and flown before reaching recording medium) when the distance is relatively long (for example, 2 mm or more), four ink droplets are continuously ejected from the nozzle (four ink droplets are combined and flown before reaching recording medium) when the distance is longer (for example, 3 mm or more) (refer to JP-A-2014-148110).

When the sub-droplets are combined with the main droplets in the air until being landed onto the printing medium, or a landed position thereof is within a range in which the main droplets are landed and formed, the sub-droplets are not actually seen in a printing result. Meanwhile, when the sub-droplets are deviated from the main droplets and landed onto the printing medium, the sub-droplets are preset in the printing result so that the image quality is deteriorated. Particularly, when the sub-droplets are generated at the time of printing letters or ruled lines, the letters or ruled lines are blurred such as giving an observer the impression of seeing double. Moreover, hereinafter, "generation" of the sub-droplets means a state in which the sub-droplets are present on the printing medium deviated from the main droplets.

The PG is correlated with the generation of the sub-droplets. An orbital of the sub-droplets, which are smaller and lighter than the main droplets, is likely to be scattered during flying, due to air resistance or the influence of air current. Accordingly, the sub-droplets are capable of being deviated from the main droplets to be followed, as much as flying time is long. As much as the PG is wide, the flying time of the ink discharged is likely to be long. For this reason, as much as the PG is wide, the sub-droplets are likely to be generated. Accordingly, measures for suppressing the deterioration of the image quality due to the sub-droplets, which are likely to be generated according to the PG, are required.

SUMMARY

An advantage of some aspects of the invention is to provide a printing control apparatus and a printing control method capable of suppressing deterioration of an image quality due to the influence of PG.

According to an aspect of the invention, there is provided a printing control apparatus which realizes printing by controlling a printing head including nozzle rows in which a plurality of nozzles are arranged in a predetermined nozzle row direction, the apparatus includes a control section that controls the printing head in which the plurality of nozzle rows discharging same types of ink are disposed to be deviated from the nozzle row direction, in which the control section is capable of selecting and performing any one of a first printing mode in which the printing is performed by setting a platen gap which is a distance from a platen supporting the printing medium on which the ink is discharged to the printing head as a first platen gap, and a second printing mode in which the printing is performed by setting the platen gap as a second platen gap which is narrower than the first platen gap, and the number of the nozzle rows used for discharging the ink in the first printing mode is smaller than the number of the nozzle rows used for discharging the ink in the second printing mode.

In this case, the number of the nozzle rows which are used in the first printing mode in which printing is performed with a relatively wide first PG is smaller than the number of the nozzle rows which are used in the second printing mode in which printing is performed with a relatively narrow second PG. Accordingly, in the first printing mode, compared to the second printing mode, the printing resolution in the nozzle row direction can be deteriorated. By deteriorating the printing resolution, since landed times of the ink per unit area of the printing medium (the number of dots per unit area) is reduced, the number of the generated sub-droplets is also reduced, as a result, the deterioration of the image quality (blurring of letters, ruled lines, or the like) due to generating of the sub-droplets can be suppressed.

In the printing control apparatus, the control section may allow a size of the ink discharged in the first printing mode to be greater than a size of the ink discharged in the second printing mode.

In this case, when the size of ink is increased in the first printing mode in which printing is performed with the relatively wide first PG, the deviation of the landed position of the ink on the printing medium is reduced, and thus, image quality can be improved.

In the printing control apparatus, the control section may allow a printing resolution in a direction intersecting with the nozzle row direction in the first printing mode to be smaller than a printing resolution in the second printing mode.

In this case, when the printing resolution of a direction intersecting with the nozzle row direction is deteriorated in the first printing mode in which printing is performed with the relatively wide first PG, the number of dots per unit area of the printing medium is relatively reduced, and thus, the number of the generated sub-droplets can be reduced.

In the printing control apparatus, when the number of the nozzle rows used in the first printing mode is set to N, the control section may use nozzle rows as N rows in vicinity of one end side of a direction intersecting with the nozzle row direction in the first printing mode.

In this case, when N nozzle rows used in the first printing mode is set to N rows inclined in one end side of a direction intersecting with the nozzle row direction, variation of nozzle intervals (intervals within group of used nozzle rows) at the time of generating a tilt in the printing head can be reduced as much as possible.

Technical ideas of the invention are also realized an apparatus other than the printing control apparatus. For example, the invention may be realized by a method including processes executed by the printing control apparatus (printing control method), a computer program causing the method to executed by a computer, or various categories of recording mediums which can be read by the computer storing the program.

BRIEF DESCRIPTION OF THE DRAWINGS

The invention will be described with reference to the accompanying drawings, wherein like numbers reference like elements.

FIG. 4 is a diagram illustrating an example of a table which assumes a corresponding relationship of a printing mode and a printing resolution, or the like.

DESCRIPTION OF EXEMPLARY EMBODIMENTS

Hereinafter, embodiments of the invention will be described with reference to each of drawings. Each of the drawings only is exemplified for describing the embodiments, and may be not matched with the other.

1. Schematic Description of Apparatus

Figure 1:
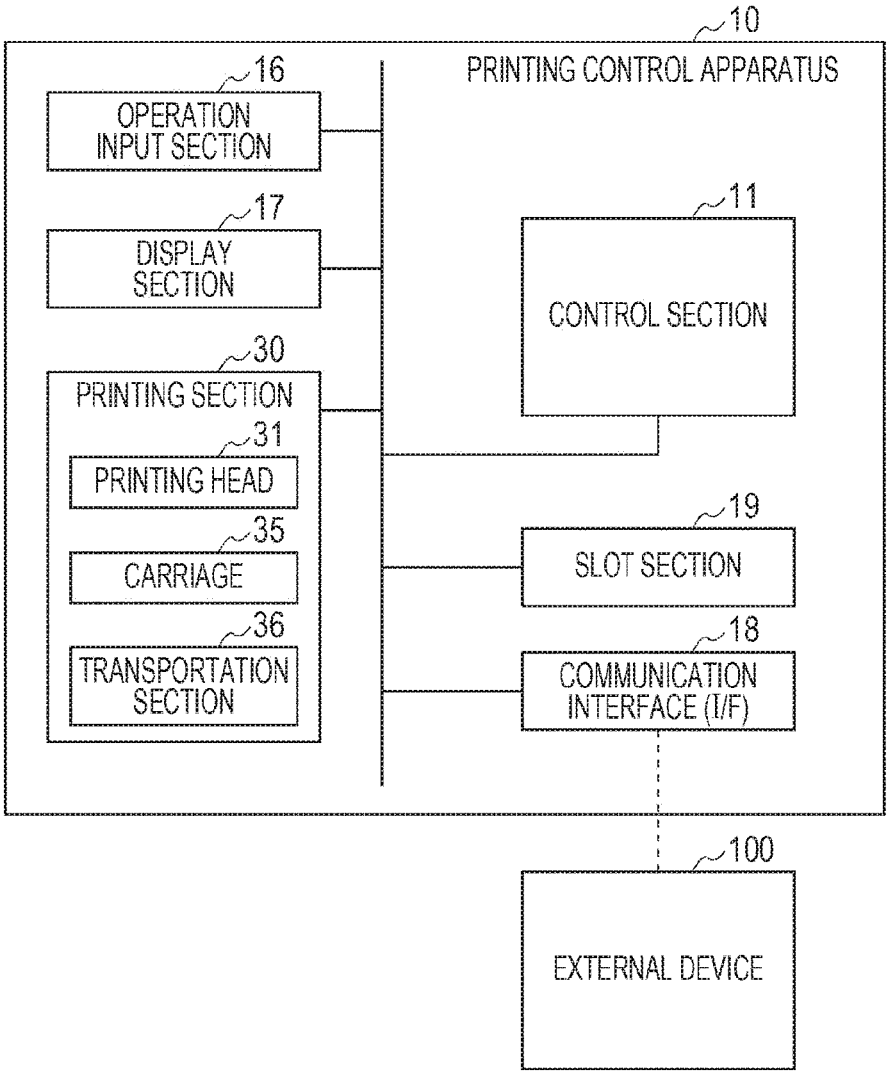
FIG. 1 is a block diagram exemplifying a configuration of an apparatus according to an embodiment.

FIG. 1 exemplifies functions of a printing control apparatus 10 according to the embodiment as a block diagram. The printing control apparatus 10 is recognized as a product, for example, a printer, or a multifunction machine including a function of the printer. When the printing control apparatus 10 is configured to have a printing section 30 which actually performs printing on a printing medium, and a configuration of a part for controlling a behavior of the printing section 30 (for example, control section 11 described later), the configuration of a part may be referred to as the printing control apparatus 10. In addition, the printing control apparatus 10 may be referred to as a printing apparatus, an image processing apparatus, or the like. Each of configurations illustrated in FIG. 1 is not limited to a case in which components are aggregated in one position or one case, and may be a system in which the components are present at a position by being separated from each other respectively and in a state of being capable of communication. For example, the printing control apparatus 10 may be configured to have a printer which actually performs printing on the printing medium and an apparatus (personal computer, or the like) in which a computer program (printer driver) for controlling a behavior of the printer is mounted so as to control the printer.

FIG. 1 exemplifies the printing control apparatus 10 which is configured to have the control section 11, an operation input section 16, a display section 17, a communication interface (I/F) 18, a slot section 19, a printing section 30, and the like. The control section 11 is configured to have, for example, an IC including a CPU, a ROM, a RAM, and the like, or the other recording medium, and the like. In the control section 11, the CPU realizes various processing (for example, printing control process to be described later) by executing arithmetic processing according to a program which is stored in the ROM, or the like by using the RAM, or the like as a work area.

The operation input section 16 includes various buttons, keys, or the like for receiving an operation performed by a user. The display section 17 is a portion for displaying various information relating to the printing control apparatus 10, and is formed of, for example, a liquid crystal display (LCD). A part of the operation input section 16 may be realized as a touch panel displayed on the display section 17.

The printing section 30 is a mechanism for printing an image on the printing medium. When a printing method is an ink jet method which is applied to the printing section 30, the printing section 30 is configured to have a printing head 31 (refer to FIG. 3), a carriage 35 which moves (main scanning) the printing head 31 in a predetermined main scanning direction, a transportation section 36 which transports the printing medium in a transportation direction intersecting with the main scanning direction, and the like. The printing section 30 may be a device which is capable of performing color printing, and may be a device which is capable of performing black-and-white printing without performing color printing.

The printing head 31 receives the ink supplied from an ink cartridge which is not illustrated. In a case in which the printing section 30 is a device which is capable of performing color printing as described above, the printing head 31 receives the ink from the ink cartridge of each of various ink (for example, cyan (C) ink, magenta (M) ink, yellow (Y) ink, black (K) ink, and the like). Meanwhile, In a case in which the printing section 30 is a device which is capable of performing black-and-white printing as described above, the printing head 31 receives the K ink from the ink cartridge of the K ink. The printing head 31 is capable of discharging (ejecting) the ink (ink droplets) from a plurality of nozzles 34 (refer to FIG. 3). Printing is realized when the discharged ink is landed onto the printing medium so as to form dots on the printing medium. The term "dots" basically means ink droplets which are landed onto the printing medium; however, even in a description relating to a process before the ink droplets are landed on the printing medium, an expression of "dots" can be appropriately used. Specific types or numbers of liquid used for the printing section 30 are not illustrated, and for example, various inks or liquid such as light cyan, light magenta, orange, green, gray, light gray, white, metallic, and the like can be used.

The transportation section 36 includes rollers for supporting and transporting the printing medium or motors for rotating the rollers (neither is illustrated). The printing medium is typical paper. However, in the embodiment, when the printing medium is made of a material which is capable of performing recording with liquid and being transported by the transportation section 36, a material other than paper is also included in a concept of the printing medium.

The communication I/F 18 is a general term of an interface for connecting the printing control apparatus 10 to an external device 100 by wired or wireless communication. As the external device 100, for example, there are various devices such as smart phones, tablet type terminals, digital steel cameras, and personal computers (PC), which become an input source of image data to the printing control apparatus 10. The printing control apparatus 10 can be connected to the external device 100 through the communication I/F 18, and for example, through various units such as a USB cable, a wired network, a wireless LAN, or an electronic mail communication or communication standard.

The slot section 19 is a portion for introducing an external recording medium such as a memory card. That is, the printing control apparatus 10 is also capable of inputting image data stored in a recording medium, from the external recording medium such as a memory card which is inserted into the slot section 19.

Figure 2:
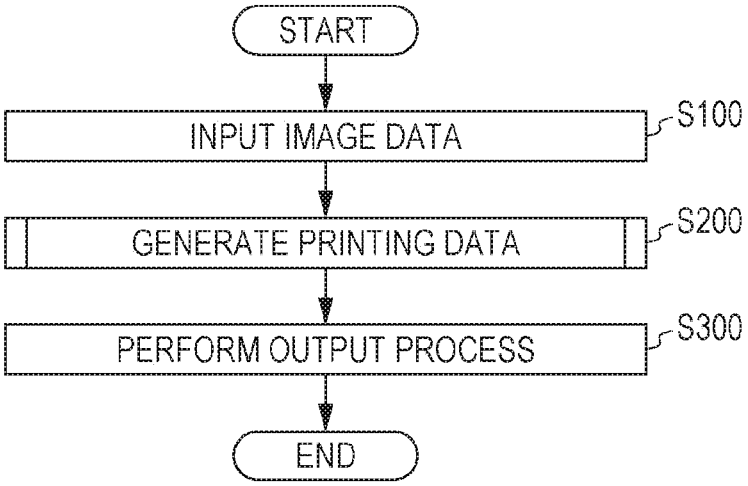
FIG. 2 is a flow chart illustrating a printing control process.

FIG. 2 illustrates a printing control process which is performed by the control section 11 using a flow chart. When inputting the image data (Step S100) expressing an image of a printing object, the control section 11 performs an image process for generating printing data from the image data (Step S200). A format of the image data is considered as various types, and for example, is data in which gradation is expressed using RGB (red, green, and blue) in each pixel. The control section 11 appropriately performs an image process such as a resolution conversion process, a color (color model) conversion process, and a halftone process with respect to the image data, so as to generate printing data in which the image of the printing object is expressed as a pattern of dots using a plurality of pixels.

The pattern of dots (dot pattern) is an arrangement of ON of the dots (formation of dots, that is, ink discharging) • OFF of the dots (non-formation of dots, that is, ink non-discharging), and it can be said that the pattern specifies ON or OFF of the dots in each pixel. When the printing section 30 corresponds to the color printing and the printing head 31 discharges, for example, the CMYK ink, the printing data includes data in which ON or OFF of the dots in each pixel is specified in each of the CMYK. Meanwhile, when the printing section 30 corresponds to the black-and-white printing and the printing head 31 discharges, for example, the K ink, the printing data is data in which ON or OFF of the dots of the K ink in each pixel. Moreover, Step S200 will be described later in detail.

Regarding each pixel constituting such a printing data, the control section 11 determines a nozzle 34 of an allocated address, and performs an output process in which, according to a determined result, the resultant is transmitted to the printing head 31 by rearranging a predetermined arrangement for being transmitted to the printing head 31 (Step S300). By allocating each of pixels to the nozzle 34, it is confirmed that the dot of each of pixels constituting the printing data is discharged according to colors of the ink and the pixel position, by any nozzle 34 of the printing head 31.

The printing head 31 drives each nozzle 34 based on the transmitted printing data. For example, a driving signal (type of pulse) for driving each nozzle 34 is applied to the printing head 31 by the control section 11. A detailed description will not be repeated; however, in the printing head 31, applying the driving signal provided in each nozzle 34 to a driving element is switched, according to information relating to ON or OFF of the dots in each pixel specified by the printing data. Accordingly, each nozzle 34 realizes discharging and non-discharging of the ink according to information relating to the pixel allocated thereto. As a result, the image of the printing object is printed on the printing medium.

Figure 3:
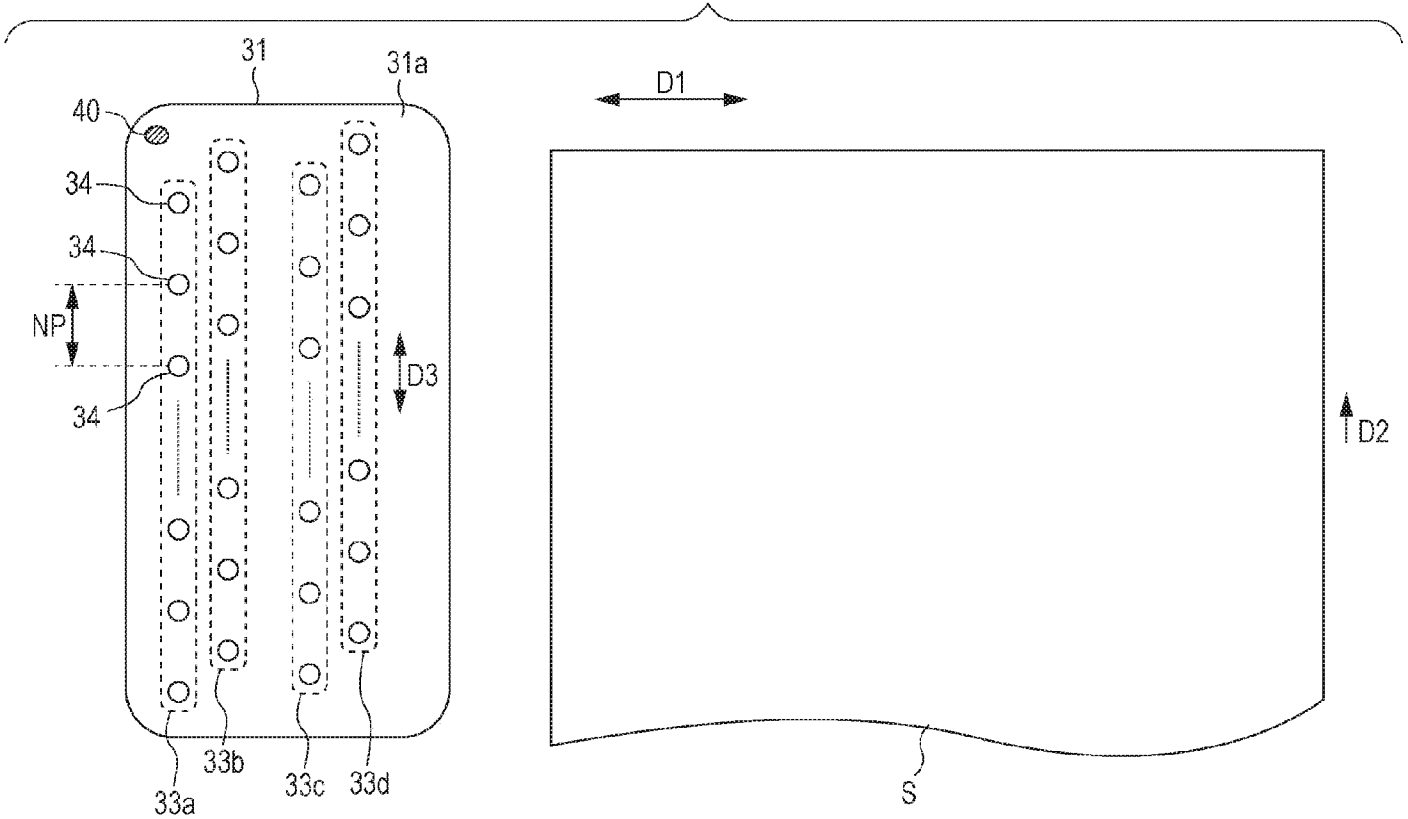
FIG. 3 is a diagram exemplifying a configuration of a printing head.

FIG. 3 simply exemplifies a configuration, or the like of the printing head 31. In FIG. 3, an arrangement of the nozzles 34 in an ink discharging surface 31*a* of the printing head 31 is exemplified from a point of view when seen from the top of the printing head 31. In FIG. 3, each of the nozzles 34 is expressed by a circle. The ink discharging surface 31*a* is a surface in which the nozzles 34 are open, and is a surface facing the printing medium S transported by the transportation section 36 in a transportation direction. In FIG. 3, a direction D1 corresponds to a main scanning direction, and a direction D2 corresponds to a transportation direction. Basically, the main scanning direction D1 and the transportation direction D2 are orthogonal to each other.

Hereinafter, unless otherwise specified, a case in which the printing section 30 corresponds to the black-and-white printing is assumed and described. In an example of FIG. 3, the printing head 31 includes nozzle rows 33*a*, 33*b*, 33*c*, and 33*d* corresponding to discharging of the K ink. The nozzle rows 33*a*, 33*b*, 33*c*, and 33*d* are respectively nozzle rows in which the plurality of nozzles 34 for discharging the K ink are arranged at predetermined intervals (constant nozzle pitch NP) in a predetermined nozzle row direction D3.

The nozzle row direction D3 where the nozzle row is toward intersects with the main scanning direction D1. It depends on a design of the printing section 30; however, the nozzle row direction D3 is orthogonal to the main scanning direction D1, or intersects with the main scanning direction at an oblique angle which is not orthogonal thereto (90 degrees). Hereinafter, for convenience of description, the nozzle row direction D3 is orthogonal to the main scanning direction D1. Accordingly, the nozzle row direction D3 and the transportation direction D2 are parallel to each other. Also, in this specification, even when expressions which is strictly interpreted, such as "orthogonal", "parallel", and "constant" are used, it does not mean "orthogonal", "parallel", and "constant", and meaning of an error allowable within a product performance or an error generated at the time of manufacturing the product also included.

A pair of the nozzle row 33*a* and the nozzle row 33*b* adjacent to each other among the nozzle rows 33*a*, 33*b*, 33*c*, and 33*d*, is disposed in a state in which positions thereof are deviated from each other in the nozzle row direction D3 as a distance of half of the nozzle pitch NP. A pair of the nozzle row 33*c* and the nozzle row 33*d* is also disposed in a state in which positions thereof are deviated from each other in the nozzle row direction D3 as a distance of half of the nozzle pitch NP. Further, the pair of the nozzle rows 33*a* and 33*b*, and the pair of the nozzle rows 33*c* and 33*d* are disposed in a state in which positions thereof are deviated from each other in the nozzle row direction D3 as a distance of ¼ of the nozzle pitch NP.

Accordingly, the nozzle resolution (the number of nozzles per 1 inch, npi) in the transportation direction D2 by the pair of the nozzle rows 33*a* and 33*b*, and the nozzle resolution in the transportation direction D2 by the pair of the nozzle rows 33*c* and 33*d*, are respectively twice of the nozzle resolution (equal to 1/NP inch) in the transportation direction D2 by one nozzle row. In addition, the nozzle resolution in the transportation direction D2 by all of the nozzle rows 33*a*, 33*b*, 33*c*, and 33*d*, is four times of the nozzle resolution in the transportation direction D2 by one nozzle row. As an example, when the nozzle resolution in the transportation direction D2 by the one nozzle row is set to 300 npi, the nozzle resolution in the transportation direction D2 by the pair of nozzle rows 33*a* and 33*b*, and the nozzle resolution in the transportation direction D2 by the pair of nozzle rows 33*c* and 33*d* are respectively 600 npi, and the nozzle resolution in the transportation direction D2 by all of the nozzle rows 33*a*, 33*b*, 33*c*, and 33*d* is 1200 npi.

The carriage 35 on which the printing head 31 is mounted receives a motivity of a carriage motor (not illustrated), and is moved parallel to the main scanning direction D1. The printing head 31 is moved together with the carriage 35 and discharges the ink onto the printing medium S so as to realize printing. A process, in which the printing head 31 discharges the ink according to a movement from one end side of the main scanning direction D1 to the other end side thereof, or a movement from the other side of the main scanning direction D1 to one end side thereof, is referred to as "main scanning" or "pass" at one time. According to such a configuration, it can be said that the printing control apparatus 10 realizes printing by controlling the printing head 31 which includes the nozzle row (for example, nozzle rows 33*a*, 33*b*, 33*c*, and 33*d*) in which the plurality of nozzles 34 are arranged in the nozzle row direction D3. In addition, it can be said that the control section 11 controls the printing head 31 in which a plurality of nozzle rows discharging the same type of ink (for example, nozzle rows 33*a*, 33*b*, 33*c*, and 33*d*) are disposed by being deviated from the nozzle row direction D3.

2. Description Relating to Printing Mode and PG

Next, the printing mode set by a user and the PG according to the printing mode will be described. The user can arbitrary set the printing mode, for example, by operating the operation input section 16 while seeing a user interface (UI) screen displayed on the display section 17 before starting the printing control process (FIG. 2) in the printing control apparatus 10. The user can simply set the printing mode by selecting a predetermined printing condition out of menus in the UI screen (for example, menu "normal paper", "envelope", and the like relating to selecting printing medium, menu for selecting "single-surface printing" or "double-surface printing", menu for selecting "enabling" or "disabling" of rubbing reducing mode, or the like). The rubbing reducing mode is an option of enabling for a case in which contacting of the printing head 31 and the printing medium S is reliably avoid.

FIG. 4 exemplifies Table T which assumes a corresponding relationship of the printing mode, and the printing resolution and the size of ink. The control section 11 stores such a Table T in a predetermined memory in advance so that Table T can be used for reference. In Table T, the PG determined according to a printing condition selected by the user is specified.

For example, with respect to a combination of the printing conditions of normal paper, single-surface printing, and the rubbing reducing mode OFF (disabling), the PG is specified to 0.9 mm.

In addition, with respect to a combination of the printing conditions of normal paper, single-surface printing, and the rubbing reducing mode ON (enabling), the PG is specified to 2.5 mm.

In addition, with respect to a combination of the printing conditions of normal paper, double-surface printing, and the rubbing reducing mode OFF, the PG is specified to 2.0 mm.

In addition, with respect to a combination of the printing conditions of normal paper, double-surface printing, and the rubbing reducing mode ON, the PG is specified to 2.5 mm.

In addition, with respect to a combination of the printing conditions of the envelope and single-surface printing, regardless ON and OFF of the rubbing reducing mode, the PG is specified to 4.4 mm. Also, when printing is performed on the envelope, double-surface printing cannot be selected.

In addition, according to Table T of FIG. 4, with respect to the PG less than 2.5 mm, horizontal and vertical printing resolutions (dpi) are respectively specified to 1200 dpi (however, in a case of normal paper, double-surface printing, and rubbing reducing mode OFF, horizontal printing resolution is specified to 900 dpi), and a weight of the ink droplets is specified to 8 nanograms (ng). Meanwhile, with respect to the PG equal to or more than 2.5 mm, the horizontal and vertical printing resolutions are respectively specified to 600 dpi, and the weight of the ink droplets is specified to 16 ng. The horizontal printing resolution is the printing resolution of the main scanning direction D1, and the vertical printing resolution indicates the printing resolution of the transportation direction D2.

In the embodiment, the nozzles 34 are capable of discharging various size ink. At least two sizes ink can be discharged because of various sizes. Two different sizes out of such various sizes are respectively referred to as a first size and a second size. Also, the first size is greater than the second size. The ink droplets having 16 ng weight per one droplet described above corresponds to an example of the ink of the first size. In addition, the ink droplets having 8 ng weight per one droplet corresponds to an example of the ink of the second size. Both of the first size and the second size indicate a size (weight) of the main droplets described above. That is, the printing section 30 is designed so as to discharge the ink (main droplets) of a size which is set to the first size, the second size, or the like in advance. Of course, since there is an error included in an actual size of the ink (main droplets) discharged from the nozzles 34, the size thereof is not strictly matched with the preset size such as the first size or the second size. In addition, as already said, sub droplets, which are fine droplets separated from the main droplets, can be generated.

The control section 11 is capable of performing one process out of at least the first printing mode in which printing is performed with the PG as a first PG and the second printing mode in which printing is performed with the PG as a second PG narrower than the first PG. When referring to Table T of FIG. 4, the 2.5 mm or more PG is referred to as the first PG, and the PG less than 2.5 mm is referred to as the second PG. That is, the control section 11 determines that the first printing mode is set in a case in which the user sets a combination of the printing conditions (for example, combination of printing conditions of normal paper, single-surface printing, and rubbing reducing mode ON) when the PG is the first PG, and the control section 11 determines that the second printing mode is set in a case in which the user sets a combination of the printing conditions (for example, combination of printing conditions of normal paper, single-surface printing, and rubbing reducing mode OFF) when the PG is the second PG.

Figure 5:
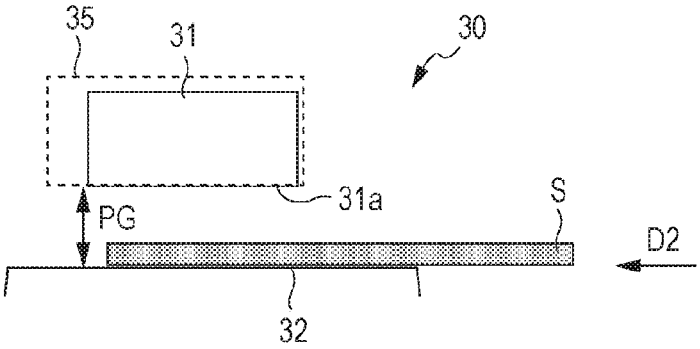
FIG. 5 is a diagram simply illustrating a configuration of a part of a range of a printing section when seen from a side.

FIG. 5 simply illustrates a configuration of a part of a range of the printing section 30 when seen from a side. In the printing section 30, the platen 32 is provided to correspond to the ink discharging surface 31*a* of the printing head 31. The printing medium S is transported onto the platen 32 in the transportation direction D2 by the transportation section 36. In FIG. 5, the main scanning direction D1 is a direction perpendicular to a surface of a paper of the drawing. As we known, the printing section 30 is capable of adjusting a height from the platen 32 to the printing head 31 (ink discharging surface 31*a*), that is, the PG, by adjusting a position of a height direction of the carriage 35, or the like.

Accordingly, when the printing mode is set according to selecting of the printing condition by the user as described above, with reference to Table T, the control section 11 specifies the PG corresponding to the printing condition currently, and adjusts the PG in the printing section 30 so as to become the specified PG. As a result, for example, when a combination (one first printing mode) of the printing conditions of the normal paper, single-surface printing, and the rubbing reducing mode ON is set, the actual PG is adjusted to be 2.5 mm. In addition, for example, when a combination (one second printing mode) of the printing conditions of the normal paper, single-surface printing, and the rubbing reducing mode OFF is set, the actual PG is adjusted to be 0.9 mm.

As already said, the PG is correlated with the generation of the sub droplets. That is, as much as the PG is wide, the sub droplets are likely to be generated. An inventor experiments a relationship of the PG and generation of the sub droplets, as a result, the inventor obtains an opinion that the sub droplets are rapidly generated at peripheries of the PG in each of substantially 2.0 to 2.5 mm. It can be said that an aspect in which the 2.5 mm or more PG is set to the first PG and the less than 2.5 mm PG is set to the second PG, is based on the opinion described above. That is, it can be said that, the first printing mode in which printing is performed with the PG as the first PG is a printing mode in which the image quality is easily deteriorated due to generation of the sub droplets, compared to the second printing mode in which printing is performed with the PG as the second PG.

Of course, specific contents (types of printing conditions and various numbers) of Table T illustrated in FIG. 4 are only an example. Technical ideas of the invention are not limited and described to the specific contents of such a Table T.

3. Generation of Printing Data and Printing Based on Printing Data

Figure 6:
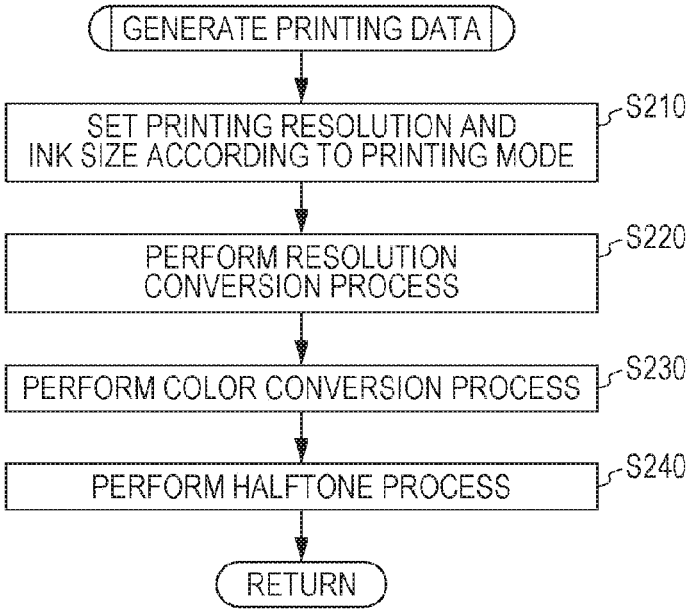
FIG. 6 is a flow chart illustrating a process of a generation of printing data.

FIG. 6 illustrates Step S200 (generation of printing data) in FIG. 2 by a flow chart in detail. In Step S210, the control section 11 sets the printing resolution and the size of the ink according to the printing mode set currently. That is, the control section 11 sets the printing resolution and the size of the ink corresponding to the first printing mode when the printing mode set currently is the first printing mode, and sets the printing resolution and the size of the ink corresponding to the second printing mode when the printing mode set currently is the second printing mode. The setting is performed with reference to Table T. According to Table T exemplified in FIG. 4, when the printing mode is the first printing mode, the horizontal and vertical printing resolutions are respectively set to 600 dpi, and the size of ink is set to the first size (weight of ink droplets is 16 ng). Meanwhile, when the printing mode is the second printing mode, the horizontal and vertical printing resolutions are respectively set to 1200 dpi (however, in a case of normal paper, double-surface printing, and rubbing reducing mode OFF, horizontal printing resolution is set to 900 dpi), and the size of the ink is set to the second size (weight of ink droplets is 8 ng).

In Step S220, the control section 11 performs the resolution conversion process on the image data input in Step S100 (FIG. 2). That is, horizontal resolution and vertical resolution of the image data are converted (compensating or thinning of pixels) so as to respectively correspond to the horizontal printing resolution and the vertical printing resolution set in Step S210 (horizontal printing resolution and vertical printing resolution adopted by the printing section 30). As a result, when current printing mode is the first printing mode, both of the horizontal resolution and the vertical resolution of the image data become 600 dpi, and when current printing mode is the second printing mode, both of the horizontal resolution and the vertical resolution of the image data become 1200 dpi (however, in a case of normal paper, double-surface printing, and the rubbing reducing mode OFF, horizontal printing resolution is 900 dpi).

Next, in Step S230, the control section 11 performs the color conversion process on image data after Step S220, and converts the image data to image data in which a density of the K ink in each pixel is expressed by gradation (for example, 256 gradation from 0 to 255). The color conversion process is performed with reference to a look up table, or the like in which a conversion relationship of RGB and K is specified and stored in a predetermined memory in advance. Otherwise, the control section 11 may specify a gradation value of K corresponding to a level of brightness of each pixel by calculating the brightness using a predetermined conversion equation from the RGB in each pixel.

In Step S240, the control section 11 generates the printing data in which the K ink is expressed by a dot pattern by performing the halftone process on the image data after Step S230. The halftone process is performed by, for example, a dither method or an error diffusion method.

Even a process in Step S300 (FIG. 2) is also restricted in contents of setting in Step S210. The control section 11 reduces the number of the nozzle rows (the number of used nozzle rows used for printing (the number of used nozzle rows)) which is an allocation address of the pixels constituting the printing data generated in Step S200, in a case in which the vertical printing resolution is set to 600 dpi (in a case of first printing mode), compared to a case in which the vertical printing resolution is set to 1200 dpi (in a case of second printing mode). Specifically, when the vertical printing resolution is set to 600 dpi, the number of the used nozzle rows is set to two, and when the vertical printing resolution is set to 1200 dpi, the number of the used nozzle rows is set to four. In Table T, the number of the used nozzle rows is also specified according to such vertical printing resolution (according to printing mode).

With reference to FIG. 3, in the embodiment, when the number of the used nozzle rows is 4, all of the nozzle rows 33*a*, 33*b*, 33*c*, and 33*d* are set to the used nozzle rows, and thus it is realized that the vertical printing resolution (printing resolution of transportation direction D2) is 1200 dpi. Meanwhile, when the number of the used nozzle rows is 2, the nozzle rows 33*a* and 33*b* among the nozzle rows 33*a*, 33*b*, 33*c*, and 33*d* are set to the used nozzle row, and thus it is realized that the vertical printing resolution (printing resolution of transportation direction D2) is 600 dpi. That is, the control section 11 determines the nozzle rows 33*a*, 33*b*, 33*c*, and 33*d* as a target when the nozzles 34 of an allocation address relating to each pixel constituting the printing data are set to the number of the used nozzle rows is 4, otherwise, when the number of the used nozzle rows is 2, the control section 11 determines by limiting to the nozzle rows 33*a* and 33*b*.

In addition, in a case in which the size of ink is set to the first size (in a case of first printing mode) and a case in which the size of ink is set to the second size (in a case of second printing mode), the control section 11 controls the printing section 30 so as to make the driving signal applying to a driving element of the nozzle 34 different. Being difference of the driving signal applied to the driving element means that, for example, a waveform or the number of the driving signals (pulse) which are applied to the driving element for forming one dot on the printing medium is different. That is, when the size of ink is set to the first size, according to information relating to dots ON of the pixels, the driving signal for discharging the ink of the first size (weight of ink droplets is 16 ng) is applied to the driving element of the nozzle 34 which is allocated to the pixel. In addition, when the size of ink is set to the second size, according to information relating to dots ON of the pixels, the driving signal for discharging the ink of the second size (weight of ink droplets is 8 ng) is applied to the driving element of the nozzle 34 which is allocated to the pixel.

Moreover, "the size of ink discharged using the nozzle 34" is not evaluated as a size of ink at the time of being discharged from the nozzle 34, and is evaluated as a size of dot formed by landing the discharged ink onto the printing medium. Because it is thought that the nozzle 34 continuously discharges various ink having substantially same size by corresponding to one pixel, and the continuously discharged various ink are combined with each other in the air so that ink becomes a large size and landed onto the printing medium. That is, the nozzle 34 may allow the first size or the second size ink to be landed onto the printing medium by discharging the ink having different size at the time of discharging according to the different driving signal, and may allow the first size or the second size ink to be landed onto the printing medium by making the number of the ink having substantially same size be different according to the different driving signal.

Even intervals of driving each nozzle 34 constituting the used nozzle row are also restricted in contents of setting in Step S210. That is, when the horizontal printing resolution is set to 600 dpi (in a case of first printing mode), the control section 11 generates the driving signal at intervals which need for driving each nozzle 34 constituting the used nozzle row (nozzle rows 33*a* and 33*b*) by corresponding to 600 dpi during moving along the main scanning direction D1 of the printing head 31. Meanwhile, when the horizontal printing resolution is set to 900 dpi or 1200 dpi (in a case of second printing mode), the control section 11 generates the driving signal at intervals which need for driving each nozzle 34 constituting the used nozzle row (nozzle rows 33*a*, 33*b*, 33*c*, and 33*d*) by corresponding to 900 dpi or 1200 dpi during moving along the main scanning direction D1 of the printing head 31.

According to the embodiment, in the printing control apparatus 10, the number of the used nozzle rows used for discharging the same types of ink in the first printing mode in which printing is performed by applying the first PG widen to any degree, or more, is smaller than the number of the used nozzle rows used for discharging the same types of ink in the second printing mode in which printing is performed by applying the relatively narrow second PG. Accordingly, in the first printing mode, the printing resolution in the nozzle row direction D3 (similar to transportation direction D2) can be deteriorated compared to the second printing mode. By deteriorating the printing resolution, landed times (the number of dots per unit area) of the ink (main droplets) per unit area of the printing medium are reduced. When the number of the main droplets is reduced, of course, the number of generation of the sub droplets is also reduced. Accordingly, in the embodiment, in the first printing mode in which the image quality is basically easily deteriorated due to the generation of the sub droplets, by suppressing the deterioration of the image quality, a printing result of a vivid image quality having less blurring (particularly, blurring of letters, ruled lines, or the like) can be obtained.

In addition, in the embodiment, in the first printing mode, compared to the second printing mode, the printing resolution in the main scanning direction D1 is also deteriorated. When the printing resolutions of the nozzle row direction D3 (similar to transportation direction D2) and the main scanning direction D1 are deteriorated, the number of dots per unit area is further reduced, and the deterioration of the image quality can be reliably reduced in the first printing mode in which the image quality is basically easily deteriorated due to the generation of the sub droplets. However, being different of the printing resolution in the main scanning direction D1 in the first printing mode and the second printing mode, is not a necessary configuration of the embodiment. For example, in Table T illustrated in FIG. 4, all of the horizontal printing resolutions may be unified as 1200 dpi.

Moreover, if the size of ink is maintained same as the size in a case in which the number of the used nozzle rows is not reduced when the number of the used nozzle rows is reduced and the printing resolution in the nozzle row direction D3 (similar to transportation direction D2) is deteriorated, there are concerns that a balance between the printing resolution and the size of ink is inappropriate and the image quality is deteriorated. For example, at the time of deteriorating the printing resolution, the size of ink is the same as that of in a case in which the number of the used nozzle rows is reduced, and thus there may be a case in which an amount of the discharged ink per unit area of the printing medium is insufficient so that the image quality is deteriorated. In consideration of such a situation, in the embodiment, the size of ink (first size) discharged in the first printing mode is increased more than the size of ink (second size) discharged in the second printing mode. Accordingly, a balance between the printing resolution and the size of ink is good, and thus the deterioration of the image quality is suppressed.

As already said, as much as the PG is wide, a flying time of the ink discharged is likely to be long. In addition, as much as the flying time of the ink is long, a deviation is generated in an orbital of the ink until being landed to the printing medium, as a result, a deviation of a landed position of the ink (deviation from ideal position to which the ink is landed basically) is likely to be generated. Such a deviation of the orbital is likely to be generated as an amount ink (light) which has a relatively small size to be landed. That is, when the PG is wide as the first PG, the deviation of the landed position of the ink is significantly generated if the size of ink is small, and for example, unnecessary backlashes, curves, or the like are likely to be generated in letters or ruled lines. In the embodiment, in the first printing mode described above, the size of ink is increased more than the size of ink in the second printing mode, the deviation of the landed position, which is likely to be generated when the PG is wide as the first PG, is reduced, backlashes, curves, or the like generated in letters or ruled lines can be suppressed.

In addition, in the embodiment, when the number of the used nozzle rows used in the first printing mode is set to N, the control section 11 uses the nozzle rows as N rows in vicinity of one end side of a direction (main scanning direction D1) intersecting with the nozzle row direction D3 in the first printing mode. N is two according to Table T in FIG. 4. One end side of the main scanning direction D1 is the left side or the right side in FIG. 3. That is, in the first printing mode, when the number of the used nozzle rows is two, the nozzle rows 33*a*, 33*b* among the nozzle rows 33*a*, 33*b*, 33*c*, and 33*d* are set to the used nozzle rows (or the nozzle rows 33*c* and 33*d* are set to the used nozzle rows). Because a tilt of the printing head 31 with respect to the transportation direction D2 (hereinafter, simply tilt of printing head 31) is considered.

Figure 7A:
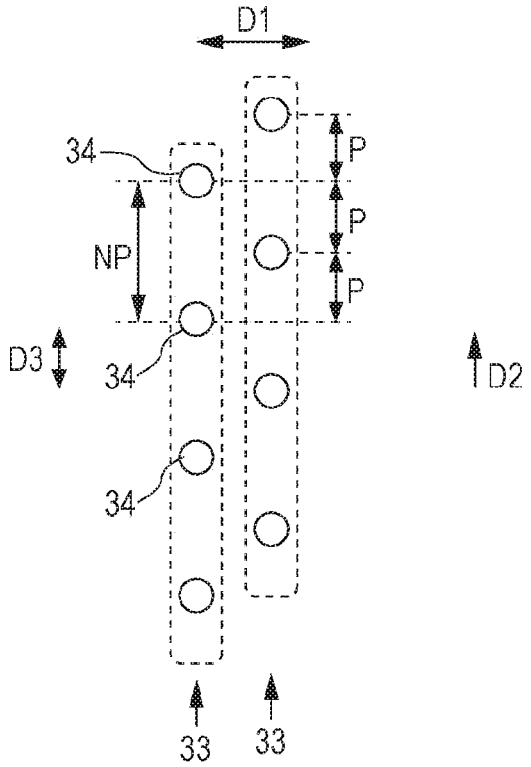
FIGS. 7A and 7B are diagrams exemplifying a case in which a nozzle row direction is not tilted and a case in which the nozzle row direction is tilted.
Figure 7B:
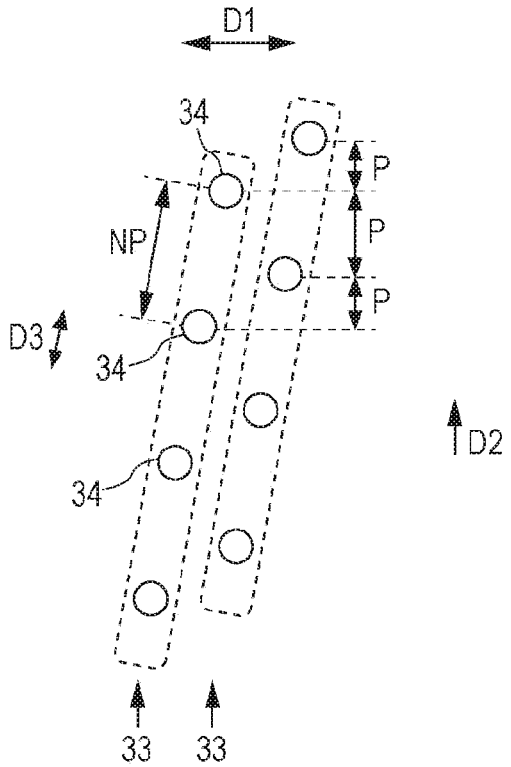

The tilt of the printing head 31 is a tilt of the nozzle row direction D3 with respect to the transportation direction D2. When the transportation direction D2 and the nozzle row direction D3 are parallel, the printing head 31 is mounted on the carriage 35 in a state of not being tilted (type of ideal state). However, regarding an actual product, since there is variation of manufacturing in each solid, the nozzle row direction D3 is slightly tilted with respect to the transportation direction D2. The transportation direction D2 and the nozzle row direction D3 are parallel, as exemplified in FIG. 7A, intervals P of the nozzles 34 in the transportation direction D2 by a group of the plurality of used nozzle rows (two used nozzle rows 33 and 33) are constant. However, when the nozzle row direction D3 is tilted with respect to the transportation direction D2, as exemplified in FIG. 7B, the intervals P of the nozzles 34 in the transportation direction D2 by the group of the plurality of used nozzle rows (two used nozzle rows 33 and 33) is not constant.

Such a variation of the intervals P (difference between narrow interval P and wide interval P) causes variation of the landed position of the ink in the transportation direction D2 to be generated. In addition, the variation of the intervals P becomes great as much as each distance between the used nozzle rows 33 and 33 in the main scanning direction D1 is away from each other. Here, in the embodiment, even if the variation of the intervals P is present, in the first printing mode, the nozzle rows (for example, nozzle rows 33*a* and 33*b*) which are close to each other in the main scanning direction D1 are set to the used nozzle rows so as to make the variation be small as possible. Accordingly, even if the tilt of the printing head 31 is present, in the first printing mode, the variation of the landed position of the ink caused by such a tilt can be as an invisible degree.

In addition, in the first printing mode, when the number of the used nozzle rows is set to two, among the nozzle rows 33*a*, 33*b*, 33*c*, and 33*d*, two nozzle rows (nozzle rows 33*a* and 33*b*) in a vicinity side of a tilt adjusting member 40 of the printing head 31 are set to the used nozzle rows. For example, as illustrated in FIG. 3, the tilt adjusting member 40 is a member provided on one of four corners of the printing head 31 (ink discharging surface 31*a*). An examiner or the user can adjust the tile of the printing head 31 by operating the tilt adjusting member 40. That is, at the center of the tilt adjusting member 40, the printing head 31 is rotated. In this case, as the nozzle row present at a position nearer than the tilt adjusting member 40, adjusting is easily performed because a changed amount of a position with respect to an adjustment amount is small, in addition, it is likely to avoid that the position is excessively changed due to adjusting. Here, from this point of view, in the first printing mode, when the number of the used nozzle rows is set to two, not the group of the nozzle rows 33*c* and 33*d*, but the group of the nozzle rows 33*a* and 33*b* near the tilt adjusting member 40 is set to the used nozzle row.

4. Modification Example

The invention is not limited to the above described embodiment, and can be performed in accordance with aspects within a range which does not depart from a gist thereof, for example, modification examples to be described below can be adopted. A configuration in which the embodiment described above and modification examples are appropriately combined is included in a disclosure range of the invention. In description of the modification examples hereinbelow, description of common issues same as the above described embodiment will not be repeated.

When the printing section 30 corresponds to color printing, a description same as a description relating to the data and the configurations of the K ink, is applied to data and configurations of the other color of ink. That is, in the same manner as that of the nozzle rows 33*a*, 33*b*, 33*c*, and 33*d* discharging the K ink, a plurality of the nozzle rows discharging the same types of ink are provided in the printing head 31 corresponding to each ink of the CMY ink, or the like. Of course, in a process of generating the printing data, the color conversion process are performed from the RGB to the CMYK, or the like.

In addition, the number of the nozzle rows included in the printing head 31 as the plurality of nozzle rows discharging the same type of the ink may be the other numbers in addition to four rows as illustrated in FIG. 3.

Hitherto, it is premised that the printing head 31 discharges the ink while being moved by the carriage 35; however, the printing head may be a line head mounted in a so called line printer. The printing head 31 as the line head, is fixed at a predetermined position in the printing section 30 without moving. In this case, the carriage 35 is unnecessary. When the printing head 31 illustrated in FIG. 3 is assumed as the line head, the printing medium S is transported by the transportation section 36 in the direction D1, not a direction D2. Even in this case, the line head (printing head 31) has the PG which is adjusted according to the printing mode, and the control section 11 changes the printing resolution or the size of the ink according to the printing mode (PG).

The entire disclosure of Japanese Patent Application No. 2015-053258, filed Mar. 17, 2015 is expressly incorporated by reference herein.

What is claimed is:

1. A printing control apparatus which realizes printing by controlling a printing head including nozzle rows in which a plurality of nozzles are arranged in a predetermined nozzle row direction, the apparatus comprising:

a control section that controls the printing head in which the plurality of nozzle rows discharging same types of ink are disposed to be deviated from the nozzle row direction, wherein the control section is capable of selecting and performing any one of a first printing mode in which the printing is performed by setting a platen gap which is a distance from a platen supporting the printing medium on which the ink is discharged to the printing head as a first platen gap, and a second printing mode in which the printing is performed by setting the platen gap as a second platen gap which is narrower than the first platen gap, and wherein the number of the nozzle rows used for discharging the ink in the first printing mode is smaller than the number of the nozzle rows used for discharging the ink in the second printing mode.

2. The printing control apparatus according to claim 1, wherein the control section allows a size of the ink discharged in the first printing mode to be greater than a size of the ink discharged in the second printing mode.

3. The printing control apparatus according to claim 1, wherein the control section allows a printing resolution in a direction intersecting with the nozzle row direction in the first printing mode to be smaller than a printing resolution in the second printing mode.

4. The printing control apparatus according to claim 1, wherein, when the number of the nozzle rows used in the first printing mode is set to N, the control section uses nozzle rows as N rows in vicinity of one end side of a direction intersecting with the nozzle row direction in the first printing mode.

5. A printing control method which realizes printing by controlling a printing head including nozzle rows in which a plurality of nozzles are arranged in a predetermined nozzle row direction, wherein a control section that controls the printing head in which the plurality of nozzle rows discharging same types of ink are disposed to be deviated from the nozzle row direction, is capable of selecting and performing any one of a first printing mode in which the printing is performed by setting a platen gap which is a distance from a platen supporting the printing medium on which the ink is discharged to the printing head as a first platen gap, and a second printing mode in which the printing is performed by setting the platen gap as a second platen gap which is narrower than the first platen gap, and wherein the number of the nozzle rows used for discharging the ink in the first printing mode is smaller than the number of the nozzle rows used for discharging the ink in the second printing mode.

* * * * *